US006863386B2

(12) United States Patent
Hatada et al.

(10) Patent No.: US 6,863,386 B2
(45) Date of Patent: Mar. 8, 2005

(54) INK MIXING DEVICE, INK MANUFACTURING APPARATUS, METHOD FOR WASHING THE INK MANUFACTURING APPARATUS, METHOD FOR MANUFACTURING INK, INK, INK CARTRIDGE CONTAINING THE INK, IMAGE FORMING METHOD AND APPARATUS USING THE INK, AND PRINT IMAGE PRODUCED BY THE IMAGE FORMING METHOD AND APPARATUS

(75) Inventors: Shigeo Hatada, Numazu (JP); Masami Iguchi, Suntoh-gun (JP); Takanori Tsuyuki, Numazu (JP); Hiromitsu Mizuno, Numazu (JP)

(73) Assignee: Ricoh Company Limited, Tokyo (JP)

( * ) Notice: Subject to any disclaimer, the term of this patent is extended or adjusted under 35 U.S.C. 154(b) by 89 days.

(21) Appl. No.: 10/459,622

(22) Filed: Jun. 12, 2003

(65) Prior Publication Data

US 2004/0066432 A1 Apr. 8, 2004

(30) Foreign Application Priority Data

Oct. 4, 2002 (JP) ..... 2002-292198

(51) Int. Cl.[7] ..... B41J 2/17
(52) U.S. Cl. ..... 347/84
(58) Field of Search ..... 347/84–86, 89, 347/6, 100; 134/88; 366/132

(56) References Cited

U.S. PATENT DOCUMENTS 5,879,439 A 3/1999 Nagai et al.
5,882,390 A 3/1999 Nagai et al.
5,972,082 A 10/1999 Koyano et al.
6,039,442 A * 3/2000 Hagiwara et al. ..... 347/89
6,052,195 A * 4/2000 Mestha et al. ..... 356/425
6,120,589 A 9/2000 Bannai et al.
6,454,401 B2 * 9/2002 Naniwa et al. ..... 347/89
6,565,642 B2 5/2003 Taniguchi et al.

FOREIGN PATENT DOCUMENTS

| | | |
|---|---|---|
| JP | 63-7828 | 1/1988 |
| JP | 63-33897 | 7/1988 |
| JP | 2000-60514 | 2/2000 |
| JP | 2002-113342 | 4/2002 |

OTHER PUBLICATIONS

U.S. Appl. No. 10/459,662, Jun. 12, 2003, Hatada et al.
U.S. Appl. No. 10/822;819, Apr. 13, 2004, Tsuyuki et al.

* cited by examiner

*Primary Examiner*—Thinh Nguyen
(74) *Attorney, Agent, or Firm*—Oblon, Spivak, McClelland, Maier & Neustadt, P.C.

(57) ABSTRACT

A mixing device for preparing an ink including: a mixing vessel including an injection nozzle and a discharge opening, both of which are provided on a bottom surface of the mixing vessel, wherein the injection nozzle faces in substantially a horizontal direction along a side surface of the mixing vessel to swirl the ink along the side surface, and the discharge opening is located on a downstream side from the injection nozzle relative to the swirling direction and at a position between the center of the bottom surface and the side surface; a connector connecting the injection nozzle with the discharge opening; and a pump configured to transport the ink from the discharge opening to the injection nozzle through the connector and inject the ink into the mixing vessel from the injection nozzle while applying a pressure to the ink.

26 Claims, 9 Drawing Sheets

INK MIXING DEVICE, INK MANUFACTURING APPARATUS, METHOD FOR WASHING THE INK MANUFACTURING APPARATUS, METHOD FOR MANUFACTURING INK, INK, INK CARTRIDGE CONTAINING THE INK, IMAGE FORMING METHOD AND APPARATUS USING THE INK, AND PRINT IMAGE PRODUCED BY THE IMAGE FORMING METHOD AND APPARATUS

BACKGROUND OF THE INVENTION

1. Field of the Invention

The present invention relates to an ink mixing device, and an ink manufacturing apparatus. In addition, the present invention relates to a method for washing the ink manufacturing apparatus. Further the present invention relates to an ink, and an ink cartridge containing the inkjet ink. Furthermore, the present invention relates to an image forming method and apparatus using the ink, and an print image produced by the image forming method and apparatus.

2. Discussion of the Background

As the inks for use in inkjet printing, fountain pens, felt pens, ink pads and the like, aqueous inks which are prepared by mixing a water-soluble dye or a pigment dispersion with water, a water-soluble organic solvent, a surfactant and the like materials have been typically used. In recent years, large item small scale production is performed on such inks using a mixing apparatus, and therefore a need exists for a mixing apparatus which can efficiently mix such materials as mentioned above in a short period of time. In addition, it is preferable for the mixing apparatus to include bubbles and foreign materials in the products in an amount as little as possible so that the resultant inks have good qualities.

Conventionally, mixing devices having an agitator such as agitating blades have been typically used. However, such mixing devices have drawbacks such that mixing has to be performed for a long time; and when the mixing time is relatively short, the ink constituents are not uniformly dispersed or solid components of the constituents remain in the resultant inks without being dissolved or dispersed therein.

In addition, it is necessary for the mixing devices that the agitator needs to be dipped into the ink constituents in a mixing vessel, i.e., the volume of the ink constituents needs to be at least half the volume of the mixing vessel. Therefore, a small quantity of ink cannot be produced by such mixing devices. Further, a number of bubbles are included in the resultant inks, and thereby problems in that the bubbles present on the surface of the inks dry, resulting in increase of the solid content of the inks or inclusion of dried inks in the inks; and when a pigment is used as a colorant, the dispersed inks aggregate due to the bubbles formed therein tend to occur. Thus, inks having good qualities cannot be produced by such mixing devices.

In addition, such mixing devices have another drawback in that when the mixing devices are washed after production of an ink, it takes a long time to wash the mixing devices because their agitators have a complex shape and therefore should be pulled up to wash the inside of the mixing vessel and the agitators. Even when a small amount of ink remains in a mixing vessel, the ink deteriorates the reliability of the ink which is prepared thereafter. Therefore it is necessary to clean the mixing devices so that the resultant ink has desired qualities.

In attempting to solve the above-mentioned problem, various mixers which perform agitation utilizing flow of the liquid to be agitated have been proposed. FIG. 4 is a schematic view illustrating the cross section of a mixing device utilizing flow of liquid to be agitated (i.e., a jet agitating mixer), which is disclosed in page 427 of Chemical Engineering Handbook. In FIG. 4, a liquid L to be agitated is injected into a vessel 10 from an injection opening 13 in a horizontal direction. He liquid L is agitated and flows in directions indicated by arrows. The liquid L is sucked from a discharge nozzle 11 by a pump P to pass through a tube 12 and is injected again into the mixing vessel 10.

In addition, another mixer utilizing flow of the liquid to be agitated is disclosed in published unexamined Japanese Patent Application No. 63-7828. The cross section of the mixer is illustrated in FIGS. 5A and 5B. In FIGS. 5A and 5B, numerals 21, 22, 23, 24, 25 and 26 denote a mixing vessel, injection/discharge nozzles, a pipe, a discharge opening, a pump and a valve. The liquid is mixed while injected into the mixing vessel 21 or discharged therefrom through the injection/discharge nozzles 22 by the pump 25 to be swirled in the mixing vessel 21.

However, the mixers disclosed in Chemical Engineering Handbook and JP-A 63-7828 have an insufficient mixing efficiency because the liquid located in the bottom of the vessels hardly moves.

FIG. 6 is a view illustrating the cross section of another mixer, which is disclosed in published examined Japanese Patent Application No. 63-33897. Referring to FIG. 6, the mixer has a mixing vessel 31 which has a cylindrical portion 31*a* and a lower conical portion 31*b*. The liquid to be mixed is extracted from the mixing vessel 31 through a pipe 33 and injected into the mixing vessel 31 from a first opening 34. In addition, the liquid is also injected into the mixing vessel 31 from a second opening 35 provided on a bottom portion of the conical portion 31*b*. Further, the liquid is also extracted from the mixing vessel 31 through pipes 36*a* and 36*b* and injected into the mixing vessel 31 from nozzles 37*a* and 37*b* provided on middle portions of the conical portion 31*b*. Numeral 32 denotes a pipe through which the liquid is circulated and injected into the mixing vessel 31 and pumps. Character P denotes a pump.

However, this mixer has the following drawbacks:

(1) since a number of openings, pipes and pumps are provided, it is hard to avoid contamination of ink; and (2) since the second opening is provided so as to face upward, the liquid tends to blow out of the liquid surface if the volume of the liquid is small.

Therefore, the mixer is not suitable for large item small scale production.

FIG. 7 is a view illustrating the cross section of another mixer, which is disclosed in published unexamined Japanese Patent Application No. 2000-60514. Referring to FIG. 7, the mixer has a mixing vessel 40 having a cylindrical or prism form on which injection openings 43 and a discharge opening 44 are provided. In addition, a flow controlling plate 45 which has a predetermined width and which projects in the mixing vessel 40 while slanting at a predetermined angle a is provided on an upper portion of the mixing vessel 40. However, the mixer has the following drawbacks:

(1) the mixer is not suitable for large item small scale production;

(2) bubbles are formed in the liquid; and (3) it is difficult to wash the flow controlling plate, and therefore it is hard to avoid contamination of ink.

FIG. 8 is a view illustrating the cross section of another mixer, which is disclosed in published unexamined Japanese Patent Application No. 2002-113342. Referring to FIG. 8, the mixer has a mixing vessel 73 and an agitator 74 configured to agitate the liquid to be mixed. The agitator 74 is provided at a lower center position of the mixing vessel 73 and has the following members:

(1) a first liquid guiding pipe 72*a* configured to blow out the liquid upwardly in the mixing vessel 73;

(2) a swirl flow forming member 75 which is provided in the mixing vessel 73 and which collides with the blown-out liquid to cause the liquid in the mixing vessel 73 to swirl in directions indicated by arrows;

(3) a second liquid guiding pipe 72*b* having an opening at a bottom portion of the mixing vessel 73 and configured to discharge the liquid from the mixing vessel 73; and (4) a pump 71 configured to transport the liquid from the second liquid guiding pipe 72*b* to the first liquid guiding pipe 72*a* through valves V1 and V5 and form a jet stream of the liquid.

However, the mixer has drawbacks in that a solid component and a gel material tend to remain at the bottom portion of the mixing vessel 73, i.e., the agitating efficiency of the mixer is not satisfactory; and the mixer is not suitable for large item small scale production because the agitator extends in the vertical direction.

Because of these reasons, a need exists for a mixing device which is suitable for large item small scale production and which can efficiently mix an ink in a short period of time without causing problems such that a large volume of babbles are included in the resultant ink and the resultant ink is contaminated with another ink.

SUMMARY OF THE INVENTION

Accordingly, an object of the present invention is to provide a mixing device which is suitable for large item small scale production and which can efficiently mix an ink in a short period of time without causing the bubbling problem and the contamination problem.

Another object of the present invention is to provide a method and apparatus for manufacturing an ink, which is suitable for large item small scale production and by which an ink can be prepared in a short period of time without causing the bubbling problem and the contamination problem.

Yet another object of the present invention is to provide a method for washing the ink manufacturing apparatus.

A further object of the present invention is to provide an ink, an ink cartridge, and an image forming method and apparatus, by which images having good image qualities can be formed.

Briefly these objects and other objects of the present invention as hereinafter will become more readily apparent can be attained by a mixing device for preparing an ink including:

a mixing vessel including an injection nozzle and a discharge opening, both of which are provided on a bottom surface of the mixing vessel, wherein the injection nozzle faces in a horizontal direction along a side surface of the mixing vessel to swirl the ink along the side surface, and the discharge opening is located on a downstream side from the injection opening relative to the swirling direction and at a position between a center of the bottom surface of the mixing vessel and the side surface (i.e., an edge of the bottom surface);

a connector such as connection pipes connecting the injection nozzle with the discharge opening; and a pump configured to transport the ink from the discharge opening to the injection nozzle through the connector and inject the ink from the injection nozzle into the mixing vessel while pressing the ink.

It is preferable that the distance between the center of the bottom surface and the center of the discharge opening is not less than ¼ and less than ¾ times the radius of the bottom surface.

In addition, the bottom surface is preferably rounded.

The flow rate of the ink injected into the mixing vessel from the injection nozzle is preferably from 1 m/s to 30 m/s.

The injection nozzle is preferably located at a position higher than the lowest position of the bottom surface by a distance not greater than 20% of the height of the mixing vessel.

The angle (vertical angle) formed by the injection nozzle and the horizontal plane is preferably from −15° to +15°. In addition, the angle (horizontal angle) formed by the injection nozzle and the tangent line at the tip of the injection nozzle of the circle whose center is the center of the bottom surface of the mixing vessel is preferably from −15° to +15°.

It is preferable that the angle formed by the line connecting the center of the bottom surface with the tip of the injection nozzle and the line connecting the center of the bottom surface with the center of the discharge opening is not less than 90° and less than 360°.

The ratio of the volume of the mixing vessel in units of liter to the area of the opening of the injection nozzle in units of square millimeter is preferably from 1 to 10.

As another aspect of the present invention, an ink manufacturing apparatus is provided which includes:

the mixing device mentioned above;

a filter configured to filter the ink after mixing the ink; and a second pump configured to feed the ink to the filter.

The pump mentioned above for use in circulating the liquid may also serve as the second pump.

As yet another aspect of the present invention, a method for washing the ink manufacturing apparatus is provided which includes:

charging the mixing vessel with a washing liquid:

circulating the washing liquid through the ink manufacturing apparatus; and then discharging the washing liquid from the ink manufacturing apparatus.

As a further aspect of the present invention, a method for preparing an ink is provided which includes:

injecting an ink into a mixing vessel from an injection nozzle provided on a bottom surface of the mixing vessel upon application of pressure to the ink to swirl the ink along a side surface of the mixing vessel;

discharging the ink from a discharge opening provided on the bottom surface of the mixing vessel, wherein the discharge opening is located on a downstream side from the injection opening relative to the swirling direction and at a position between a center of the bottom surface of the mixing vessel and an edge of the bottom surface; and feeding the ink from the discharge opening to the injection opening while applying a pressure to the ink to circulate the ink.

It is preferable that the ink preparing method further includes:

filtering the ink after mixing is completed.

As a still further aspect of the present invention, an ink is provided which is prepared by using the ink manufacturing method or apparatus mentioned above.

The ink preferably has a viscosity not greater than 20 mPa·s.

As a still further aspect of the present invention, an ink cartridge is provided which includes a container and the ink prepared by using the ink manufacturing method or apparatus mentioned above and contained in the container.

As a still further aspect of the present invention, an image forming apparatus is provided which includes the inkjet cartridge and an inkjet printhead configured to discharge the ink contained in the ink cartridge to form an image on a receiving material.

As a still further aspect of the present invention, an image forming method is provided which includes:

discharging the inkjet ink mentioned above from a nozzle to form an image on a receiving material.

As a still further aspect of the present invention, an image produced by the image forming method mentioned above is provided.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention will be explained in detail referring drawings.

Figure 1B:
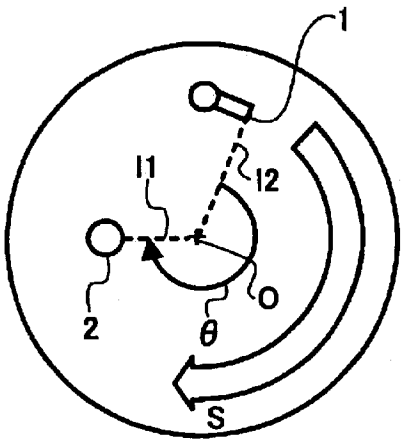
FIGS. 1A and 1B are a perspective view and a plan view illustrating an embodiment of the mixing device of the present invention.
Figure 1A:
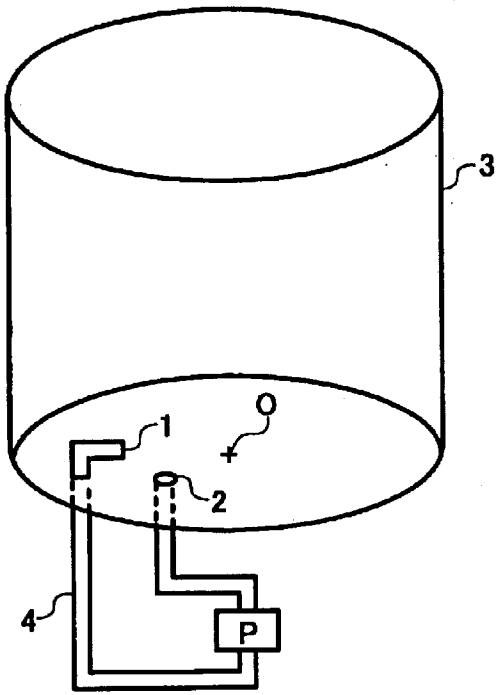
Figure 2:
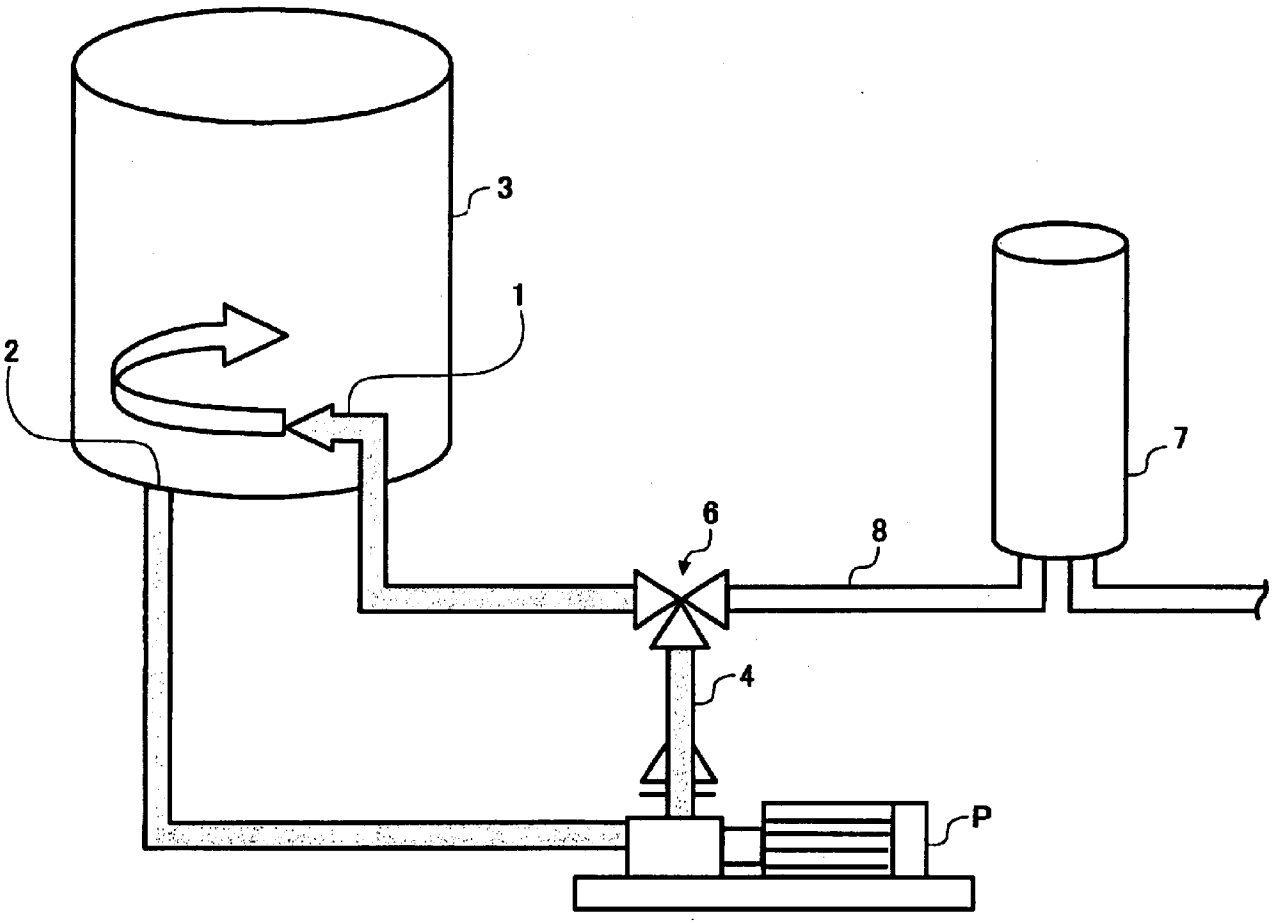
FIG. 2 is a schematic view illustrating an embodiment of the ink manufacturing apparatus of the present invention.

FIGS. 1A and 1B are a perspective view and a plan view illustrating the main portion of an embodiment of the mixing device of the present invention. FIG. 2 is a schematic view illustrating the main portion of an embodiment of the ink manufacturing apparatus of the present invention.

Referring to FIGS. 1A and 1B, the mixing device of the present invention includes at least a mixing vessel 3, a discharge opening 2 provided on the bottom surface of a mixing vessel 3, an injection nozzle 1 also provided on the bottom surface of a mixing vessel 3, and a connection pipe 4 serving as a connector and connecting the injection nozzle 1 with the discharge opening 2. A liquid to be mixed (hereinafter referred to as an ink) is discharged in the horizontal direction from the injection nozzle 1 along the side surface of the mixing vessel 3 to swirl the ink in a direction indicated by an arrow S. The opening of the injection nozzle 1 faces in the horizontal direction.

The discharge opening 2 is located on a downstream side from the injection nozzle 1 relative to the swirling direction indicated by the arrow S. Namely, the angle θ formed by lines l1 and l2 is not less than 90° and less than 360°. In addition, the discharge opening 2 is located at a position between a center O of the bottom surface of the mixing vessel 3 and the side surface of the mixing vessel 3. In addition, a pump P is provided on the connection pipe 4 to feed the ink from the discharge opening 2 to the injection nozzle 1 and discharge the ink into the mixing vessel 3 from the injection nozzle 1 while applying a pressure to the ink.

Referring to FIG. 2, a pipe 8 can be connected to a portion of the connection pipe 4, which portion is located between the discharge opening 2 and the pump P, through a valve 6. After the mixing operation is completed, the ink is fed to a filter 7 through the valve 6 and the pipe 8 to be filtered. In this case, the pump P can be used for feeding the ink to the filter 7 as well as for circulating the ink, or another pump may be provided for feeding the ink. Thus, the ink manufacturing apparatus includes at least the mixing device of the present invention and a filtering device.

The mixing device of the present invention is characterized by including an injection nozzle and a discharge opening, which have specific structures and positional relationships. Therefore the objects of the present invention can be attained. In particular, the power to agitate the ink in the mixing vessel can be applied by the injection nozzle 1 which is smaller in size than agitators (such as agitating blades) used in conventional mixing devices. In addition, the opening of the injection nozzle 1 faces in the horizontal direction, and thereby bouncing of the ink can be avoided. Therefore, the mixing device of the present invention is suitable for large item small scale ink production. In addition, since there is no agitator but only an injection nozzle and a discharge opening in the mixing vessel, the mixing device has a good cleaning property.

The distance between the center O of the bottom surface of the mixing vessel 1 and the center of the discharge opening 2 is preferably not less than ¼ and less than ¾ times the radius of the mixing vessel (i.e., the radius of the bottom surface) to prevent the resultant ink from including bubbles therein. When the distance is less than ¼ times the radius, the resultant ink tends to include bubbles therein. In contrast, when the distance is not less than ¾ times the radius, the ink in the center portion of the mixing vessel tends to remain therein without being hardly agitated, i.e., the ink is not fully agitated.

The bottom surface of the mixing vessel 1 is preferably rounded, and the connection part of the bottom surface with the side surface is preferably smooth. In addition, it is preferable that the discharge opening is located at a lowest position of the bottom surface. When the bottom surface is flat, the ink near the connection part tends not to be fully agitated, and in addition the ink is not smoothly flown from the injection nozzle toward the discharge opening, resulting in deterioration of agitating efficiency. When the discharge opening is not located at a lowest position of the bottom surface, a part of the ink cannot be fully agitated, resulting in deterioration of agitating efficiency.

The flow rate of the ink discharged from the injection nozzle 1 is preferably from 1 m/s to 30 m/s, and more preferably from 3 m/s to 20 m/s. When the flow rate is less than 1 m/s, the ink cannot be fully agitated. In contrast, when the flow rate is greater than 30 m/s, the ink tends to include bubbles therein, resulting in deterioration of the ink properties. In addition, a problem in that the ink is blown out and thereby the mixing device is contaminated by the ink tends to occur. In the present application, the flow rate is determined by dividing the volume of the ink fed per unit time (1 second) by the cross sectional area of the opening of the injection nozzle 1.

The height of the injection nozzle 1 (i.e., the vertical distance between the injection nozzle and the lowest portion of the bottom surface) is preferably 20% or less of the height of the mixing vessel 1 (i.e., the vertical distance between the lowest portion of the bottom surface to the uppermost surface of the mixing vessel (or the upper edge of the side surface)). When the height is greater than 20%, a small amount of ink cannot be well agitated, i.e., the large item small scale production ability of the mixing device deteriorates.

Figure 9A:
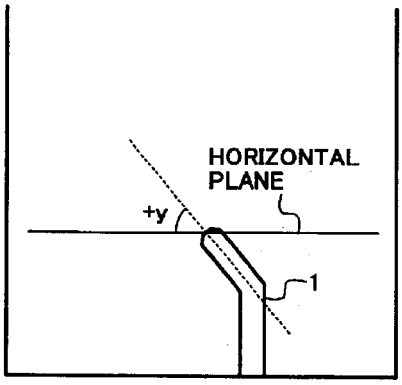
FIGS. 9A and 9B are schematic views for explaining how the vertical angle of the injection nozzle is measured.
Figure 9B:
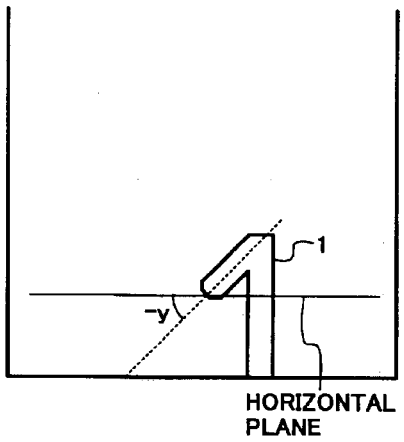

The angle (sometimes referred to as the vertical angle y) formed by the injection nozzle 1 and the horizontal plane is from −15° to +15°. FIGS. 9A and 9B are schematic views for explaining how the vertical angle y is measured. When the vertical angle y is less than −15° (i.e., the injection nozzle faces too downwardly), the agitating efficiency of the mixing device tends to deteriorate. When the angle y is greater than +15° (i.e., the injection nozzle faces too upwardly), not only the agitating efficiency of the mixing device tends to deteriorate, but also the ink tends to be blown out, resulting in inclusion of bubbles in the resultant ink and contamination of the mixing device with the ink.

Figure 10A:
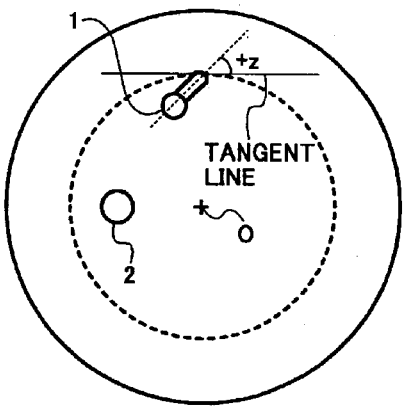
FIGS. 10A and 10B are schematic views for explaining how the horizontal angle of the injection nozzle is measured
Figure 10B:
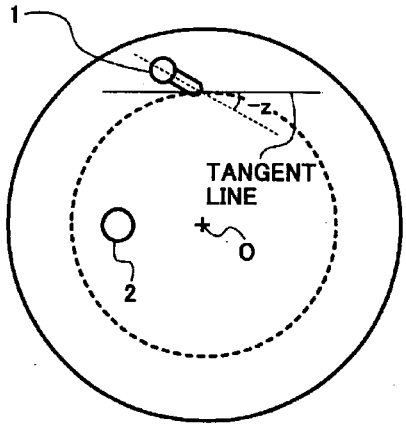

The angle (sometimes referred to as the horizontal angle z) formed by the injection nozzle 1 and the tangent line touching the circle with center O at the tip of the injection nozzle is from −15° to +15°. FIGS. 10A and 10B are schematic views for explaining how the horizontal angle z is measured. When the horizontal angle z is less than −15° (i.e., the injection nozzle faces too inwardly) or greater than +15° (i.e., the injection nozzle faces too outwardly), the agitating efficiency of the mixing device tends to deteriorate.

Referring to FIG. 1B, the angle θ between the lines l1 and l2 is preferably not less than 90° and less than 360°. When the angle θ is less than 90°, the ink discharged from the injection nozzle 1 is soon discharged from the discharge opening 2 and thereby the ink located in a portion of the mixing vessel 3 far from the discharge opening 2 cannot be fully agitated.

The ratio of the volume in units of liter of the mixing vessel to the cross sectional area in units of square millimeter of the opening of the injection nozzle 1 is preferably 1 to 10, and more preferably from 2 to 7. When the ratio is too small (i.e., the area of the opening of the injection nozzle is relatively large), a high-capacity pump needs to be used to flow the ink at the desired flow rate, resulting in increase of manufacturing costs. In contrast, when the ratio is too large (i.e., the area of the opening of the injection nozzle is relatively small), the ink cannot be well agitated.

The mixing device of the present invention is suitable for mixing and agitating an ink, particularly an inkjet ink. When an ink is prepared while contaminated by another ink, a clogging problem in that nozzles of the inkjet printhead used are clogged with large particles tends to occur. Namely, the resultant ink has poor reliability. In addition, when an ink is prepared while bubbles are included therein, the clogging problem is also caused due to solid particles of the ink formed due to the bubbles. In addition, a pigment ink is dispersed while forming bubbles, the ink cannot be stably dispersed, resulting in deterioration of the ink properties.

However, when the mixing device of the present invention is used, the ink to be agitated can be well agitated without causing the above-mentioned problems such as the contamination, bubbling and insufficient dispersion problems. Therefore the resultant ink has good reliability and good printing properties.

In general, when an ink is prepared, a filtering operation in which foreign particles in the ink are removed therefrom is performed after a mixing operation. In the present invention, the pump circulating the ink can also serve as the pump feeding the ink to the filter. Therefore, the ink manufacturing apparatus has a simple structure (i.e., the setting space of the apparatus can be minimized) and is low-cost.

The mixing device and ink manufacturing apparatus of the present invention can be easily washed after the mixing operation is completed. For example, the following method can be used. A washing liquid such as water and organic solvents is fed into the mixing vessel to be circulated, and then the washing liquid is discharged (after passing through the filter, if necessary).

In the present invention, the ink can be manufactured by the following method. At first, ink constituents such as colorants, water, water-soluble organic solvents, and surfactants are fed into the mixing vessel. Then the constituents are mixed and agitated while circulated by the pump. After being uniformly mixed, the constituents are optionally fed to the filter to be filtered. Thus, an ink is prepared.

When a dye is used as the colorant, a solid dye or a dye solution can be fed into the mixing vessel. When a pigment is used as the colorant, it is preferable to feed a pigment dispersion into the mixing vessel.

Suitable materials for use as the colorant of the ink include dyes and pigments.

Suitable dyes for use as the colorant include dyes classified into acid dyes, direct dyes, and reactive dyes in color index.

Specific examples of acid dyes include Acid Yellow 17, 23, 42, 44, 79 and 142; Acid Red 35, 42, 52, 82, 87, 92, 134, 249, 254 and 289; Acid Blue 1, 9, 15, 59, 93 and 249; Acid Black 2.

Specific examples of the direct dyes include Direct Yellow 33, 44, 50, 86, and 144; Direct Orange 26; Direct Red 9, 17, 28, 81, 83, 89, 225 and 227; Direct Blue 15, 76, 86, 200, 201 and 202; and Direct Black 19, 22, 32, 38, 51, 154 and 168.

Specific examples of the reactive dyes include Reactive Yellow 17; Reactive Red 6 and 180; and Reactive Blue 2.

Specific examples of the black pigments for use as the colorant include carbon black manufactured by a furnace method or a channel method; and self-dispersive pigments which are prepared by subjecting the black pigments to a surface treatment.

Specific examples of the yellow pigments for use as the colorant include Pigment Yellow 1, 2, 3, 12, 13, 14, 16, 17, 73, 74, 75, 83, 93, 95, 97, 98, 114, 120, 128, 129, 138, 150, 151, 154, 155 and 180.

Specific examples of the magenta pigments for use as the colorant include Pigment Red 5, 7, 12, 48(Ca), 48(Mn), 57(Ca) 57:1, 112, 122, 123, 168, 184 and 202; and Pigment Violet 19.

Specific examples of the cyan pigments for use as the colorant include Pigment Blue 1, 2, 3, 15, 15:3, 15:4, 16, 22 and 60; Vat Blue 4 and 60; and aluminum phthalocyanine.

Specific examples of the water-soluble organic solvents include alcohols such as methanol, ethanol, 1-propanol, 2-propanol, 1-butanol, 2-butanol and isobutyl alcohol; polyhydric alcohols such as ethylene glycol, diethylene glycol, triethylene glycol, propylene glycol, 1,2-propanediol, 1,2-butanediol, 1,3-butanediol, 1,4-butanediol, and glycerin; mono- or di-ether derivatives which can be prepared by dehydration-condensing one or more of the polyhydric alcohols mentioned above with one or more of the alcohols mentioned above; pyrrolidone derivatives such as N-methyl pyrrolidone and 2-pyrrolidone; ketones such as acetone and methyl ethyl ketone; alkanol amines such as monoethanol amine, diethanol amine and triethanol amine.

Suitable surfactants for use in the ink of the present invention include known nonionic surfactants, anionic surfactants, cationic surfactants and amphoteric surfactants.

In addition to the materials mentioned above, various additives such as antiseptics can also be included in the ink.

The ink of the present invention preferably has a viscosity not higher than 20 mPs·s. Inks having too high viscosity cannot be fully agitated by the mixing device of the present invention. In addition, such highly viscous inks cannot be well discharged from nozzles of inkjet printheads. It is possible to include one or more materials, which have a viscosity not less than 100 mPs·s, in the ink. In the present application, the viscosity of the ink is measured by a viscometer RE80L manufactured by Toki Sangyo Kabushiki Kaisha under the following measuring conditions.

Rotor: conical rotor (tip faces downwardly)
- radius: 24 mm
- angle formed by conical surface and horizontal plane at the tip thereof: 1°34'

Revolution of rotor: 20 rpm

The inkjet ink of the present invention can be used for continuously-projecting type inkjet printing methods (apparatus) and on-demand type inkjet printing methods (apparatus). Specific examples of the on-demand type inkjet printing methods include piezoelectric inkjet et printing methods, thermal inkjet printing methods and electrostatic inkjet printing methods. The ink of the present invention can be used for each of the recording methods.

Figure 3:
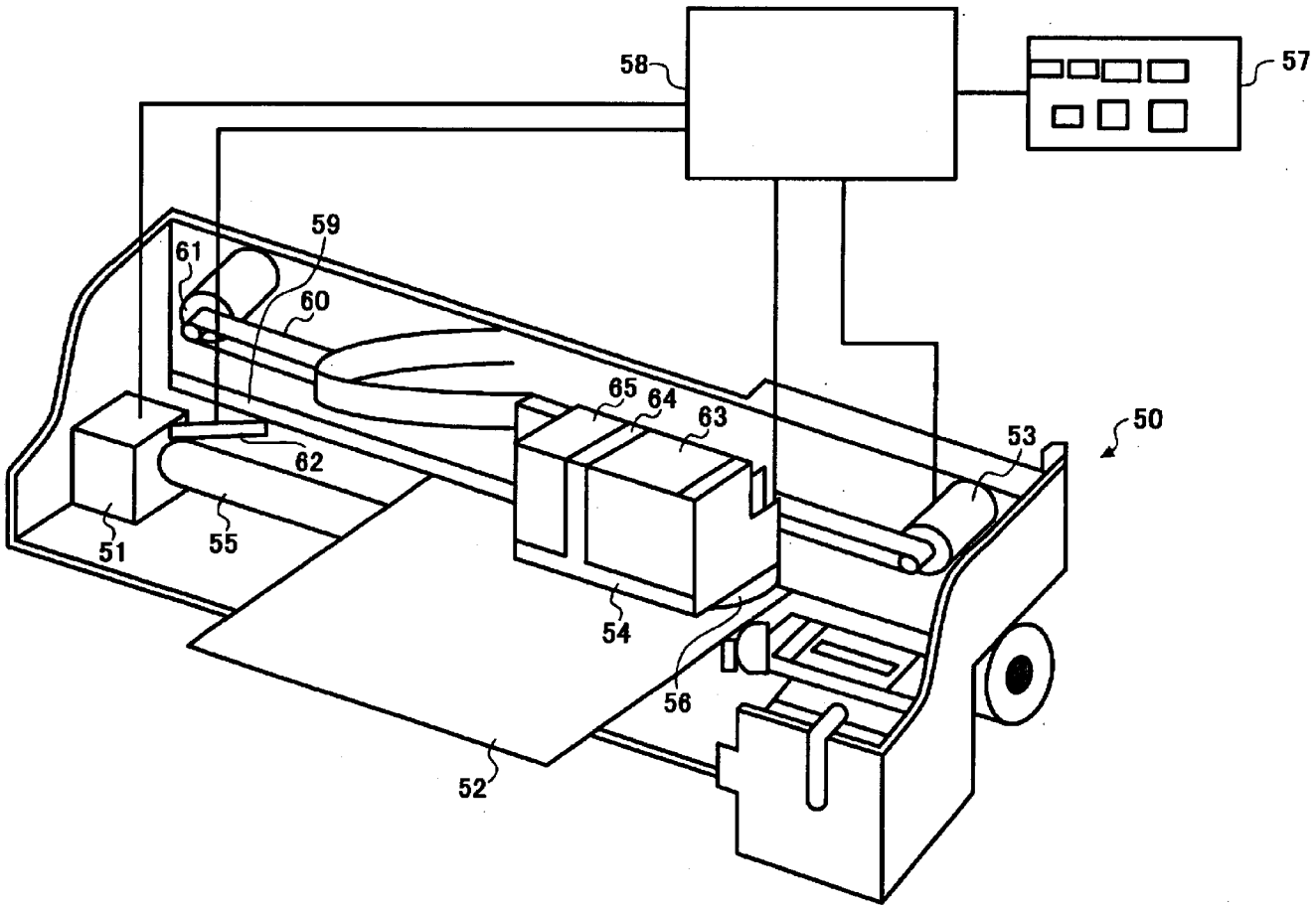
FIG. 3 is a schematic view illustrating an embodiment of the image forming apparatus of the present invention.
Figure 4:
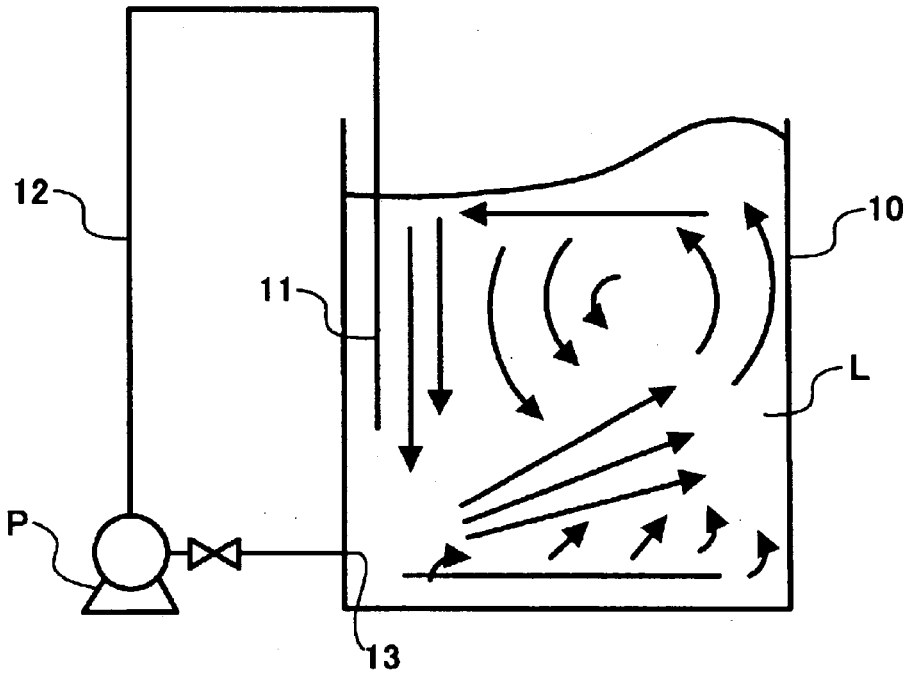
FIG. 4 BACKGROUND ART
FIG. 4 is a schematic view illustrating a background mixing device without using an agitating device.
Figure 5B:
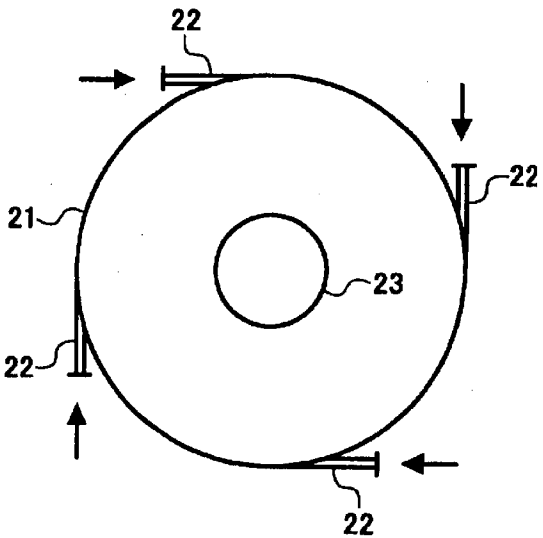
FIG. 5B BACKGROUND ART
FIGS. 5A and 5B are a cross sectional view and a plan view illustrating another background mixing device without using an agitating device.
Figure 5A:
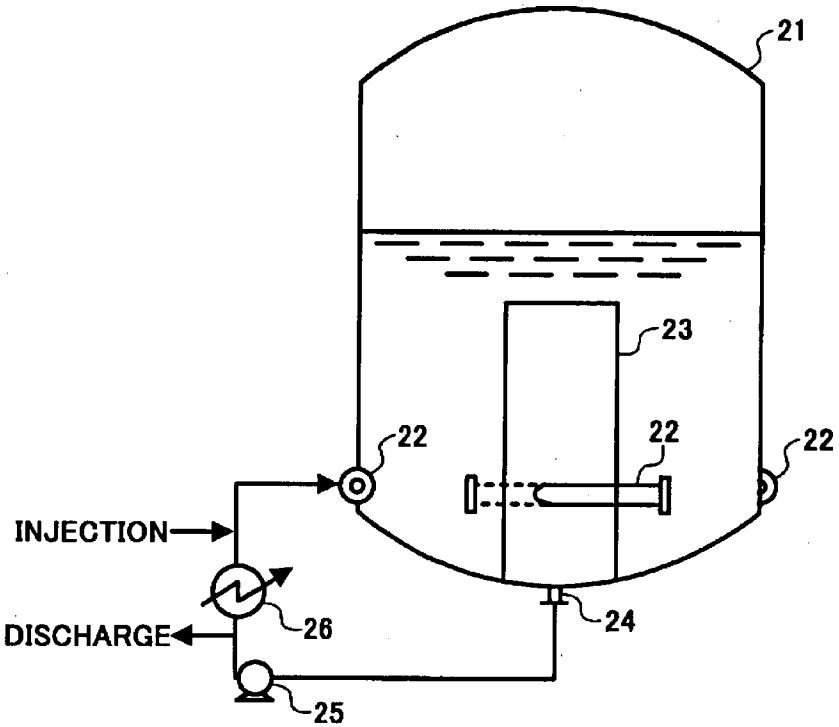
FIG. 5A BACKGROUND ART
Figure 6:
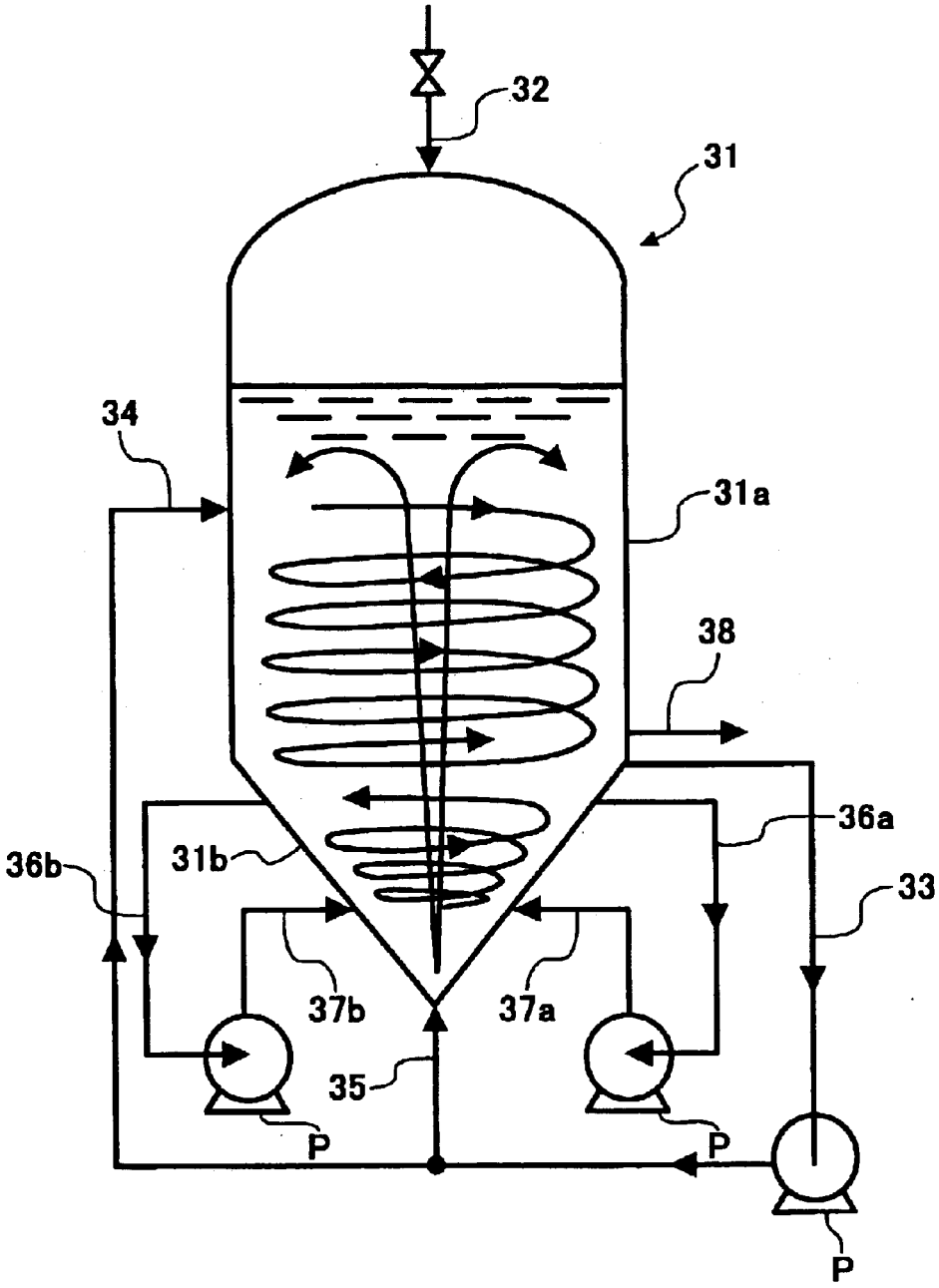
FIG. 6 BACKGROUND ART
FIG. 6 is a schematic view illustrating another background mixing device without using an agitating device.
Figure 7:
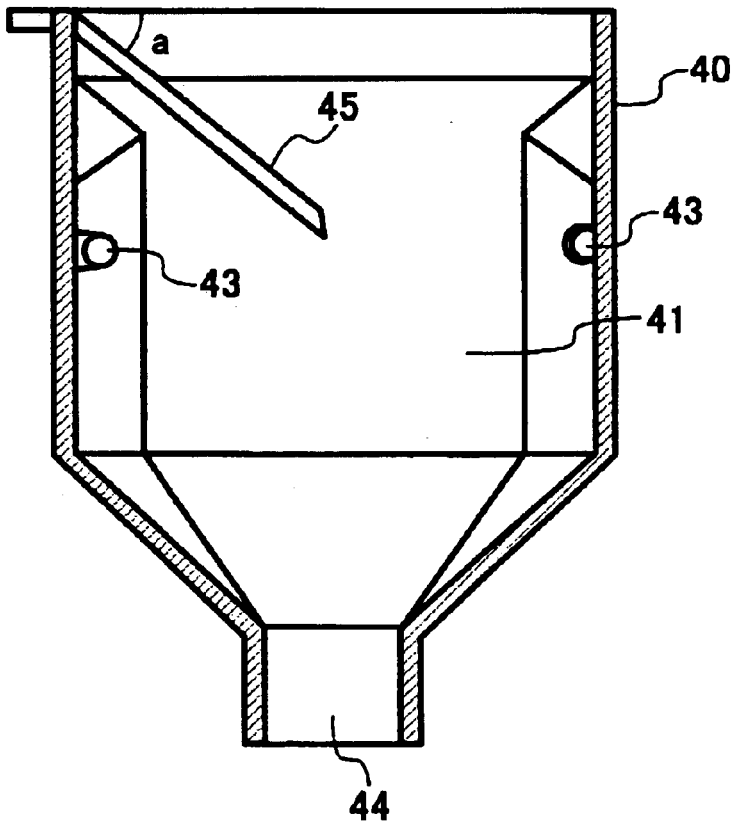
FIG. 7 BACKGROUND ART
FIG. 7 is a schematic view illustrating another background mixing device without using an agitating device.
Figure 8:
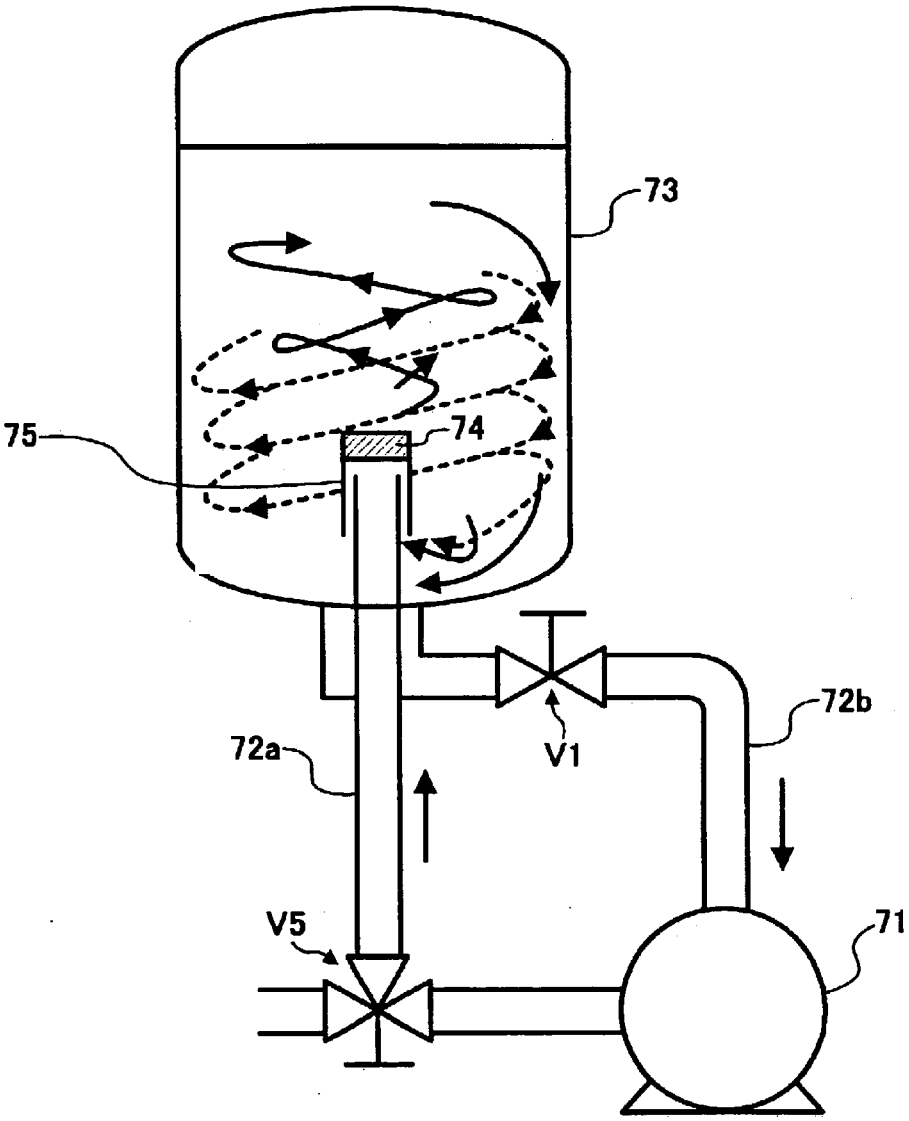
FIG. 8 BACKGROUND ART
FIG. 8 is a schematic view illustrating a background mixing device using an agitating device.

An embodiment of the inkjet printing apparatus of the present invention is illustrated in FIG. 3.

An inkjet printing apparatus 50 includes a paper feeding mechanism configured to feed a paper 52 using a paper feeding motor 51; a carriage feeding mechanism configured to reciprocate a carriage 54 while the carriage 54 faces a platen roller 55; a printing mechanism configured to drive a printhead 56 provided on the carriage 54 to discharge the ink of the present invention; an operation panel 57; and a controller 58 configured to receive and send signals with the operation panel 57.

The paper feeding mechanism feeding the paper 52, which is a receiving material, also includes a gear train configured to transport the revolution of the paper feeding motor 51 to a paper feeding roller (not shown) as well as to the platen roller 55. In addition, the carriage feeding mechanism also includes a sliding shaft 59 which is arranged so as to be parallel to the shaft of the platen roller 55 and which supports the carriage 54 to slide; a pulley 61 which tightly stretches an endless driving belt 60 together with a carriage motor 53; and a carriage position sensor 62 configured to detect the original position of the carriage 54. On the carriage 54, a color ink cartridge 63 and a black color ink cartridge 65 are set. Numeral 64 denotes a partition plate.

The controller is not illustrated in FIG. 3, but the controller provided in the inkjet printing apparatus includes, for example, an arithmetic and logic circuit including a CPU, a P-ROM and a RAM which store programs, and a character generator which stores dot matrixes of characters. In addition, an I/F dedicated communication circuit, a head driving circuit which is connected with the I/F dedicated communication circuit and which drives the printhead 56, and a motor driving circuit which drives the paper feeding motor 51 and the carriage motor 53, can also be provided therein.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The schematic view of the ink manufacturing apparatus used in Examples 1 to 4 is illustrated in FIG. 2. The diameter, depth and volume of the mixing vessel 3 are 175 mm, 550 mm and 40 liters, respectively. The bottom surface of the mixing vessel 3 is rounded. In addition, an injection nozzle and a discharge opening are provided on the bottom surface, and the conditions of the injection nozzle and the discharge opening, and other conditions are as follows:

(1) distance between the center of the bottom surface and the center of the discharge opening: 70 mm
(2) height of the injection nozzle from the bottom surface: 68 mm;
(3) vertical angle y of the injection nozzle: 0°;
(4) horizontal angle z of the injection nozzle: 0°;
(5) angle θ (in FIG. 1): 180°;
(6) cross section of opening of the injection nozzle: 12.6 $mm^2$ (i.e., 4 mm ϕ);
(7) pump: ROTARY PUMP MF25 (manufactured by Hanazuka Seisakusho Kabushiki Kaisha);
(8) revolution of the pump: 850 rpm (during mixing operation) 250 rpm (during filtering operation);
(9) flow rate of ink: 12 m/s;
(10) mixing time: 30 minutes; and
(11) filter: cylindrical filter, PROFILE II, manufactured by Japan Paul Co. and having openings of 1.0 μm and a length of 10 inches).

The below-mentioned ink constituents were mixed for 30 minutes under the above-mentioned conditions.

Formula of Ink (a) (Total Amount of 10 kg)

| | |
|---|---|
| Dispersion of self-dispersive black pigment (CAB-O-JET300 manufactured by Cabot Corp., solid content of 15%) | 3333 g |
| Glycerin | 500 g |
| Diethylene glycol | 1500 g |

-continued

| | |
|---|---|
| Sodium salt of polyoxyethylene (3) alkyl (C13) ether acetic acid | 100 g |
| Water | 4567 g |

Then the valve 6 was changed to subject the mixed ink to a filtering treatment under the above-mentioned conditions. Thus, an ink (a) was prepared. The ink (a) had a viscosity of 2.6 mPa·s. After preparation of ink (a), about 5 liters of pure water were added to the mixing vessel to wash the ink manufacturing apparatus and then discharged after passing the wash water through the filter. When this washing operation was repeated 5 times, the ink manufacturing apparatus could be cleaned. Thus, the washing treatment could be easily performed.

Example 2

The procedure for preparation of the ink (a) in Example 1 was repeated except that the ink manufacturing apparatus was modified such that the discharge opening is located at the center of the bottom surface and the height of the injection nozzle is 200 mm; and the total amount of the ink was changed to 40 kg;. Thus, an ink (b) was prepared. In this case, the flow rate of the ink was 12 m/s. The ink (b) included bubbles therein during the mixing operation, but the mixing could be performed without causing any problem. In addition, the ink manufacturing apparatus had the same washing efficiency as that of the ink manufacturing apparatus used in Example 1.

Example 3

The procedure for preparation of the ink (a) in Example 1 was repeated except that the ink manufacturing apparatus was modified such that the vertical and horizontal angles y and z of the injection nozzle are −10° and −10°, respectively; the angle θ is 90°; and the cross sectional area of the opening of the injection nozzle is 7.1 $mm^2$ (3 mm ϕ). Thus, an ink (c) was prepared. In this case, the flow rate of the ink was 18 m/s. The mixing efficiency of the ink manufacturing apparatus was slightly inferior to that of the ink manufacturing apparatus in Example 1, but the ink could be prepared without causing any problem. In addition, the ink manufacturing apparatus had the same washing efficiency as that of the ink manufacturing apparatus used in Example 1.

Example 4

The procedure for preparation of the ink (a) in Example 1 was repeated except that the ink manufacturing apparatus was modified such that the angles y and z of the injection nozzle are −20° and −20°, respectively; the angle θ is 60°; and the cross sectional area of the opening of the injection nozzle is 3.1 $mm^2$ (2 mm ϕ). Thus, an ink (d) was prepared. In this case, the flow rate of the ink was 22 m/s. The mixing efficiency of the ink manufacturing apparatus was slightly inferior to that of the ink manufacturing apparatus in Example 3, but the ink could be prepared without causing any problem. In addition, the ink manufacturing apparatus had the same washing efficiency as that of the ink manufacturing apparatus used in Example 1.

Comparative Example 1

The procedure for preparation of the ink (a) in Example 1 was repeated except that an ink manufacturing apparatus using an agitating blade having a diameter of 20 cm was used. As a result, the ink was spattered, and therefore agitation could not be performed. In addition, the ink manufacturing apparatus has worse washing efficiency than the ink manufacturing apparatus used in Example 1 because the number of portions to be washed is larger (i.e., the washing area is large) and the mixing device has a complex structure.

Evaluation of the Inks

Each of the inks (a) to (d) was set in a black cartridge of an inkjet printer EM-900C manufactured by Seiko Epson Corp. and then deaerated in vacuum. Then images were formed on a plain paper 4024 manufactured by Xerox Corp. using the printer. All the printed images have good image qualities, and there was no difference in image qualities between the images.

Effects of the Present Invention

As clearly understood from the above description, the ink mixing device and the ink manufacturing apparatus of the present invention are suitable for large item small scale production and can efficiently mix an ink in a short period of time without causing the bubbling problem and the contamination problem.

This document claims priority and contains subject matter related to Japanese Patent Application No. 2002-292198, filed on Oct. 4, 2002, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A mixing device for preparing an ink, comprising:

a mixing vessel including an injection nozzle and a discharge opening, both of which are provided on a bottom surface of the mixing vessel, wherein the injection nozzle faces in substantially a horizontal direction along a side surface of the mixing vessel to swirl the ink along the side surface, and the discharge opening is located on a downstream side from the injection nozzle relative to a swirling direction of the ink and at a position between a center of the bottom surface and the side surface of the mixing vessel;

a connector connecting the injection nozzle with the discharge opening; and a pump configured to transport the ink from the discharge opening to the injection nozzle through the connector and inject the ink into the mixing vessel from the injection nozzle while applying a pressure to the ink.

2. The mixing device according to claim 1, wherein the bottom surface is circular, and wherein a distance between the center of the bottom surface and a center of the discharge opening is not less than ¼ and less than ¾ times a radius of the bottom surface.

3. The mixing device according to claim 1, wherein the bottom surface is rounded.

4. The mixing device according to claim 1, wherein the ink is discharged into the mixing vessel from the injection nozzle at a flow rate of from 1 m/s to 30 m/s.

5. The mixing device according to claim 1, wherein the injection nozzle is located at a position higher than a lowest position of the bottom surface by a distance not greater than 20% of a height of the mixing vessel.

6. The mixing device according to claim 1, wherein a vertical angle formed by the injection nozzle and a horizontal plane is from −15° to +15°.

7. The mixing device according to claim 1, wherein a horizontal angle formed by the injection nozzle and a tangent line at a tip of the injection nozzle of a circle whose center is the center of the bottom surface is from −15° to +15°.

8. The mixing device according to claim 1, wherein an angle formed by a line connecting the center of the bottom surface and a tip of the injection nozzle and a line connecting the center of the bottom surface and a center of the discharge opening is not less than 90° and less than 360°.

9. The mixing device according to claim 1, wherein a ratio of volume of the mixing vessel in units of liter to an area of an opening of the injection nozzle in units of square millimeter is preferably from 1 to 10.

10. An ink manufacturing apparatus for preparing an ink, comprising:

the mixing device according to claim 1;

a filter configured to filter the ink from the mixing device after mixing the ink; and a second pump configured to feed the ink to the filter.

11. The ink manufacturing apparatus according to claim 10, wherein the pump of the mixing device serves as the second pump.

12. A method for washing the ink manufacturing apparatus according to claim 10, comprising:

charging the mixing vessel with a washing liquid;

circulating the washing liquid through the ink manufacturing apparatus; and then discharging the washing liquid from the ink manufacturing apparatus.

13. An ink which is prepared by the ink manufacturing apparatus according to claim 10.

14. The ink according to claim 13, wherein the ink has a viscosity not greater than 20 mPa·s.

15. An ink cartridge comprising:

a container; and the ink according to claim 13 contained in the container.

16. An image forming apparatus comprising:

the inkjet cartridge according to claim 15; and an inkjet printhead configured to discharge the ink contained in the ink cartridge to form an image on a receiving material.

17. An image forming method comprising:

discharging the ink according to claim 13 from a nozzle to form an image on a receiving material.

18. An image produced by the image forming method according to claim 17.

19. A method for manufacturing an ink, comprising:

injecting an ink into a mixing vessel from an injection nozzle provided on a bottom surface of the mixing vessel upon application of pressure to the ink to swirl the ink along a side surface of the mixing vessel to agitate the ink;

discharging the ink from a discharge opening provided on the bottom surface of the mixing vessel, wherein the discharge opening is located on a downstream side from the injection nozzle relative to a swirling direction of the ink and at a position between a center of the bottom surface of the mixing vessel and the side surface of the mixing vessel; and feeding the ink from the discharge opening to the injection nozzle to circulate the ink.

20. The method according to claim 19, further comprising:

filtering the ink after agitating the ink.

21. An ink which is prepared by the method according to claim 19.

22. The ink according to claim 21, wherein the ink has a viscosity not greater than 20 mPa·s.

23. An ink cartridge comprising:

a container; and the ink according to claim 21 contained in the container.

24. An image forming apparatus comprising:

the inkjet cartridge according to claim 23; and an inkjet printhead configured to discharge the ink contained in the ink cartridge to form an image on a receiving material.

25. An image forming method comprising:

discharging the ink according to claim 21 from a nozzle to form an image on a receiving material.

26. An image produced by the image forming method according to claim 25.

* * * * *